US007282115B2

(12) United States Patent
Bianchini

(10) Patent No.: US 7,282,115 B2
(45) Date of Patent: Oct. 16, 2007

(54) METHOD FOR MITIGATING THE INTERFERENCE CAUSED BY HIGH-MOLECULAR WEIGHT-BY-PRODUCTS IN PULPING PROCESSES

(76) Inventor: Craig A. Bianchini, 18 Crawford La., Nashau, NH (US) 03063

( * ) Notice: Subject to any disclaimer, the term of this patent is extended or adjusted under 35 U.S.C. 154(b) by 63 days.

(21) Appl. No.: 10/718,395

(22) Filed: Nov. 20, 2003

(65) Prior Publication Data

US 2004/0099386 A1 May 27, 2004

Related U.S. Application Data

(62) Division of application No. 09/917,337, filed on Jul. 27, 2001, now Pat. No. 6,752,903.

(51) Int. Cl.

| | |
|---|---|
| ***D21C 9/02*** | (2006.01) |
| ***D21C 9/08*** | (2006.01) |
| ***D21C 11/00*** | (2006.01) |
| ***D21C 3/22*** | (2006.01) |

(52) U.S. Cl. ..... 162/60; 162/41; 162/42; 162/48; 162/55; 162/65; 162/189

(58) Field of Classification Search ..... 162/60–62, 162/29, 42, 41, 43, 249, 280, 189, 55, 52, 162/36, 65, 14–19, 30.1, 30.11, 37, 38, 48, 162/90, 233, 239; 210/928
See application file for complete search history.

(56) References Cited

U.S. PATENT DOCUMENTS

| | | | | |
|---|---|---|---|---|
| 3,758,405 | A * | 9/1973 | Fremont | 162/29 |
| 3,843,473 | A * | 10/1974 | Samuelson | 162/40 |
| 4,096,028 | A | 6/1978 | Rosenberger | |
| 4,226,673 | A * | 10/1980 | Fremont | 162/29 |
| 4,670,098 | A * | 6/1987 | Thorsell et al. | 162/29 |
| 4,806,203 | A * | 2/1989 | Elton | 162/19 |
| 5,127,992 | A * | 7/1992 | Davies et al. | 162/29 |
| 5,290,454 | A * | 3/1994 | Dorica et al. | 210/710 |
| 5,296,099 | A | 3/1994 | Griggs et al. | |
| 5,360,514 | A | 11/1994 | Henricson et al. | |
| 5,470,481 | A * | 11/1995 | Modell et al. | 210/652 |
| 5,509,999 | A | 4/1996 | Lindberg | |
| 5,620,562 | A | 4/1997 | Marcoccia et al. | |
| 6,733,625 | B2 * | 5/2004 | Henricson et al. | 162/60 |

* cited by examiner

*Primary Examiner*—Eric Hug
(74) *Attorney, Agent, or Firm*—Design IP

(57) ABSTRACT

Separation of dissolved and colloidal high molecular weight organic by-products from liquors or filtrates in a cellulosic pulping process to improve the overall efficiency of the process.

8 Claims, 7 Drawing Sheets

METHOD FOR MITIGATING THE INTERFERENCE CAUSED BY HIGH-MOLECULAR WEIGHT-BY-PRODUCTS IN PULPING PROCESSES

This application is a divisional of U.S. application Ser. No. 09/917,337 filed Jul. 27, 2001, now U.S. Pat. No. 6,752,903.

BACKGROUND OF THE INVENTION

The present invention pertains to processes for pulping cellulosic materials, e.g., wood, bagasse and straw pulping.

In the manufacture of pulp from cellulosic materials for making paper, cardboard and related products the cellulosic fibers must be liberated from the cellulosic materials using liquid chemicals. The suspended solids of cellulosic fibers subsequently must be liberated and collected from the liquors.

The most common pulping processes employ cooking or digesting a cellulosic material, e.g. wood chips, to separate the cellulosic fibers from lignin and other materials in the wood chips. Side reactions of the pulping process produce high molecular weight organic by-products which include compounds of lignin, tar, pitch, saponified fatty acids and resins and other chemicals released from the wood chips.

During digesting processes, which can utilize a material, such as sulfate, caustic, sulfite, or alcohols, which is introduced into the digester along with the source of cellulosic fiber, with the digester raised to an elevated temperature and under pressure, the cellulosic fibers are released from the host material. Along with the fibers the high molecular weight organic by-products are released and become soluble in the liquid or pulping liquor. The high molecular weight organic by-products become dissolved or colloidal solids.

At the present time two commercial chemical processes are used to produce the cellulosic fiber material, i.e., Kraft or Sulfate Cooking and Acid or Sulfite Cooking. Another process that is the subject of promising laboratory work is Alcohol based Cooking (ASAM).

During and after the fiber producing material is cooked or digested and the fibers are released, the fibers are separated from the rest of the material and some or all of the spent cooking liquor can be used for further cooking of cellulosic material through circulating and recirculating the liquor. Dissolved solids in the spent liquor interfere in the initial cooking step or subsequent cooking steps. After the cooking process, the fiber is washed to remove residual cooking liquor and side reaction compounds. Further delignification can be obtained using oxygen and caustic which is commercially referred to as oxygen delignification within the washing sequence.

During the cleaning or washing processes during the manufacture of unbleached or bleached fibers, spent filtrate containing high molecular weight organic by-products can interfere with the physical and chemical processes needed to efficiently clean the fibers for the paper product. For example, a typical process of washing the fibers uses a cascading arrangement for the washing filtrate. Relatively clean water is introduced at the final washing stage and is cascaded back through several washing devices downstream to the first washing device. The washing equipment extracts the high molecular weight molecules which are carried on the fibers. The contaminated pulp, after washing yields a dirty filtrate which is sent to a preceding step in the washing process. Eventually, the high weight molecular organic by-products in the dirty filtrate interferes with efficient washing of the pulp. Also, residual high molecular weight material not removed from the fiber material interferes with a subsequent bleaching process.

Thus removal of the high weight molecular organic by-products will increase the efficiency of the cooking, washing, and bleaching processes involved in the production of pulp.

BRIEF DESCRIPTION OF THE INVENTION

The present invention is a method for improving the overall process efficiency of a sulfite, Kraft or alcohol pulping process by removing dissolved high molecular weight organic by-products from any liquor or filtrate stream withdrawn from any process step by passing the liquor or filtrate stream through a filtration media that will trap the high molecular weight organic by-products and, returning the liquor or filtrate to any suitable point in the cooking, washing or bleaching process.

The liquor or filtrate freed of all or a portion of high molecular weight organic by-products will reduce the chemical or physical interference in a suitable process step that normally utilize the spent liquor or filtrate and thus increase the overall efficiency of the pulping process.

Thus in one aspect, the present invention is a method for improving the efficiency of the batch digesting step of a wood fiber pulping process comprising steps of; separating at least a portion of the liquor from wood pulp during or after the digesting step and passing the liquor through a filtration media to remove dissolved high molecular weight organic by-products from the liquor, and returning the liquor after removal of the high molecular weight organic by-products to any digester.

In another aspect, the present invention is a method for improving the overall efficiency of the batch digesting step in a Kraft pulping process comprising the steps of taking black liquor separated from wood pulp during or after the digesting step and passing the black liquor through a filtration media to remove dissolved high molecular weight organic by-products from the liquor, and returning the black liquor after removal of the high molecular weight organic by-products to a digester.

In still another aspect, the present invention is a method for improving the overall efficiency of the batch digesting steps of a sulfite pulping process comprising the steps of taking liquor separated from wood pulp during or after the digesting step and passing the liquor through a filtration media to remove dissolved high molecular weight organic by-products from the liquor, and returning the liquor after removal of the high molecular weight organic by-products to a digester.

In a further aspect, the present invention is a method for improving the efficiency of a wood pulping process using a continuous digester comprising a step of incorporating into a liquor recirculating or circulating system associated with the continuous digester a filtration media to remove high molecular weight organic by-products from the recirculating or circulating liquor.

A still further aspect the present invention is a method for improving the efficiency of a wood pulping process incorporating storage of spent liquor comprising the step of passing the liquor entering the storage facility to a filtration step to remove dissolved high molecular weight organic by-products from the liquor.

In still another aspect, the present invention is a method for improving the efficiency of a wood pulping process incorporating storage of one of spent liquor or filtrate, comprising the step of either prior to or upon withdrawing the liquor or filtrate from the storage facility passing the liquor or filtrate through a filtration media to remove dissolved high molecular weight organic by-products from the liquor or filtrate.

In yet a further aspect, the present invention is a method for improving the efficiency of a wood pulping process incorporating accumulation of hot liquor in pressurized vessels comprising the step of either prior to or upon withdrawing the liquor from the accumulation facility passing the liquor through a filtration media to remove dissolved high molecular weight organic by-products from the liquor.

Another aspect of the present invention is a method for improving the efficiency of a wood pulping process incorporating recycle of one of liquor or filtrate in the wood pulping process, comprising the step of passing liquor or filtrate from any process step through a filtration media to remove colloidal or dissolved high molecular weight organic by-products from the liquor or filtrate and recycling the liquor or filtrate to any appropriate step in the wood pulping process.

A further aspect of the present invention is a method for improving the efficiency of a wood pulping process including fiber washing comprising the steps of; passing collected washing liquid through a filtration media to remove colloidal and/or dissolved high molecular weight organic by-products from the washing liquid to produce a cleaned washing liquid, and using the cleaned washing liquid as a washing liquid or for pulp dilution.

A still further aspect of the present invention is a method for improving the efficiency of a wood pulping process that includes oxygen as a delignification step preceded by and followed by washing of pulp, comprising the steps of; separating washing fluid from the pulp after one of any washing step preceding or any washing step following the oxygen delignification step, passing the separated washing fluid from the pulp through a filtration media to remove colloidal and/or dissolved high molecular weight organic by-products from the washing fluid, to produce a cleaned washing fluid and using the cleaned washing fluid in any washing operation or to dilute the pulp prior to, after or during oxygen delignification.

DETAILED DESCRIPTION OF THE INVENTION

The entire disclosure of U.S. patent application Ser. No. 09/917,337 filed is expressly incorporated by reference herein.

In describing the present invention it should be noted that at the present time there are two commercially practiced chemical cooking (digesting) processes to which the invention is particularly applicable. These are the Kraft pulping process where sulfate cooking or digesting is used and the acid process wherein sulfite cooking or digesting is used. Another process that is not commercial at this time but which has shown promising results in the laboratory involves pulping using an alcohol cooking step.

For the existing processes there are two types of reactors currently in use. There are batch reactors and continuous reactors. The batch reactor employs two different cooking methods, conventional batch and displacement batch.

In pulping processes there are two types of storage devices that are used to store liquor or filtrate during the processing of the pulp. These are atmospheric tanks and pressurized accumulators.

In the Kraft or sulfate cooking process the liquor withdrawn from the digester is referred to as "black liquor" while the liquor withdrawn from the acid (sulfite) cooking step is referred to as hydrolysate. Therefore, in describing and claiming the present invention the term liquor is used to encompass both sulfate cooking and sulfite cooking. This would also cover alcohol cooking since the alcohol cooking step results in a liquor from which the fibers are separated.

Figure 1:
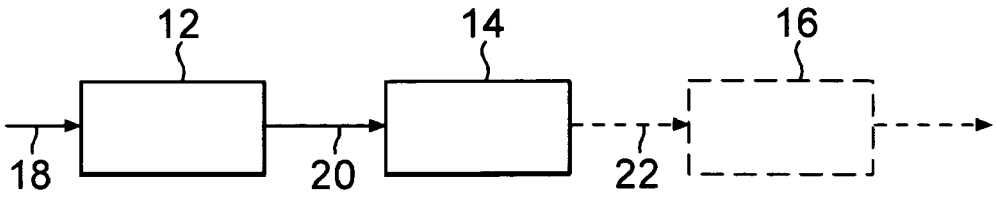
FIG. 1 is a schematic representation of a basic fiber process.

Referring to FIG. 1 a conventional pulping process 10 includes the steps of cooking represented by box 12, washing represented by box 14 and optionally bleaching represented by box 16. The steps are joined by arrows 18, 20, and 22 to show the processes are carried out in sequence. In the cooking step, which is common to sulfate, sulfite or alcohol pulping processes, the process of the present invention is applied by adding a separation device in selected lines where liquor is withdrawn from a digester or liquor storage device and passing the withdrawn liquor through a separation or filtration device that will remove the colloidal or dissolved high molecular weight organic by-products from the circulating or recirculated liquor. The separation device or filter media used in practicing the invention is any micro filtration media that will remove the colloidal or dissolved high molecular weight organic by-products e.g., dissolved molecules having a molecular weight greater than 1,000. Membrane technology would serve this purpose and would be effective to remove the high molecular weight organic by-products. Micro-granular media could also be utilized. Several types of media are available to accomplish this task and the invention should not be limited to any particular filtration media. It may be necessary, depending upon the nature and size of the high molecular weight organic by-products to use a combination of particle filtration, ultrafiltration and microfiltration to reduce or remove the unwanted high molecular weight by-products.

Figure 2:
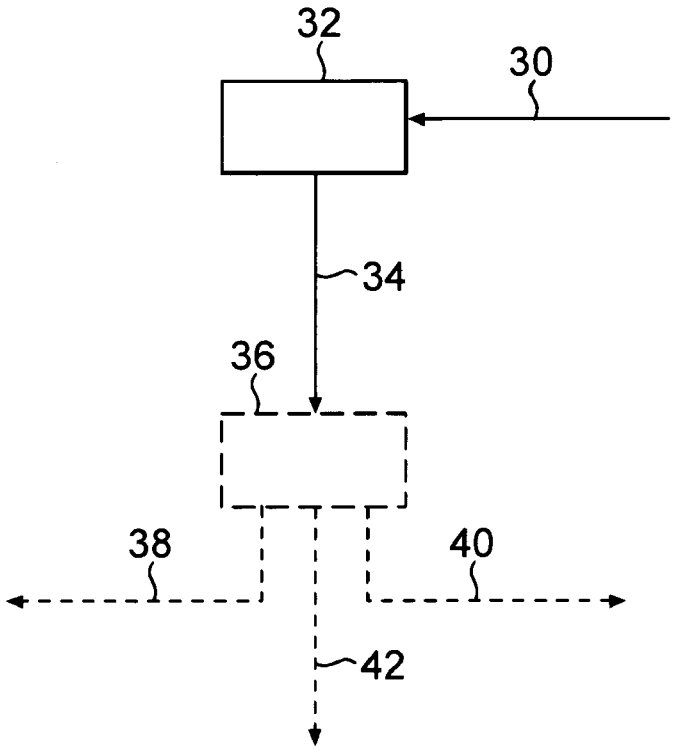
FIG. 2 is a schematic representation of the process of the present invention applied to washing of digested pulp.

FIG. 2 is a schematic representation of fiber washing where the process of the invention is used to clean filtrate containing organic solids (colloidal or dissolved high molecular weight organic by-products) which is represented by arrow 30. The filtrate 30 with high molecular weight organic solids is passed through a separator 32 which contains a media adapted to remove high molecular weight solids. A filtrate lower in concentrates of high molecular weight organic solids represented by arrow 34 is then sent to a pulp washing apparatus 36. Contaminated pulp represented by arrow 38 enters the washing device 36 where it is contacted with the filtrate to yield an output of washed pulp represented by a line 40 and a dirty filtrate represented by line 42.

Figure 3:
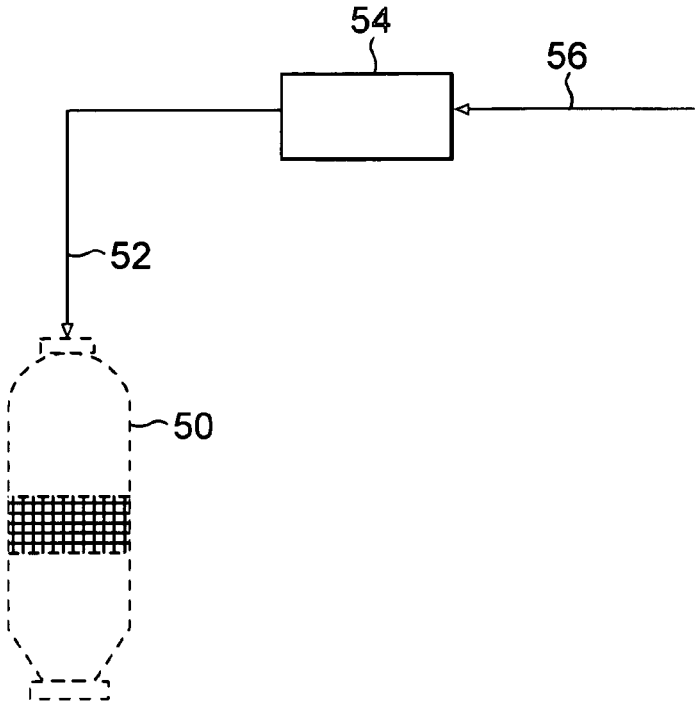
FIG. 3 is a schematic representation of the process of the present invention applied to a conventional batch digester.

Referring to FIG. 3 a conventional batch digester 50 can be charged with a recycled liquor or filtrate represented by line 52 which has passed through a separation step 54 which receives a liquor containing high molecular weight organic solids as shown by arrow 56. The liquor lower in concentration of high molecular weight organic solids represented by arrow 52 is introduced into the digester which then gives up its chemical values to the digesting of newly added material to be pulped, such as wood chips.

Figure 4:
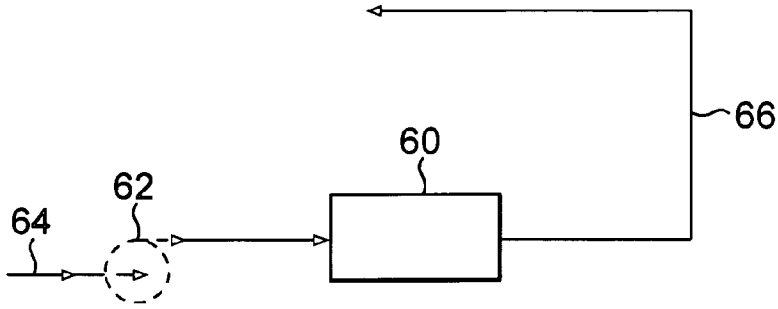
FIG. 4 is a schematic representation of the process of the present invention applied to a displacement and conventional batch digester process.

FIG. 4 is a schematic representation of the present invention applied to a conventional or a displacement batch digester wherein the separator 60 is connected to the digester liquor recirculation system 62 which in turn receives liquor from any digester nozzle, the liquor from the digester being represented by arrow 64. After the liquor from the digester recirculation system is passed through the separator 60 where the high molecular weight organic by-products are removed, the cleaned or treated liquor is eventually returned to any digester nozzle via line 66. A heat exchanger (not shown) can be incorporated into any part of the liquor recirculation system to raise or lower the temperature of the liquor in accord with the overall digester and separation media requirements.

Figure 5:
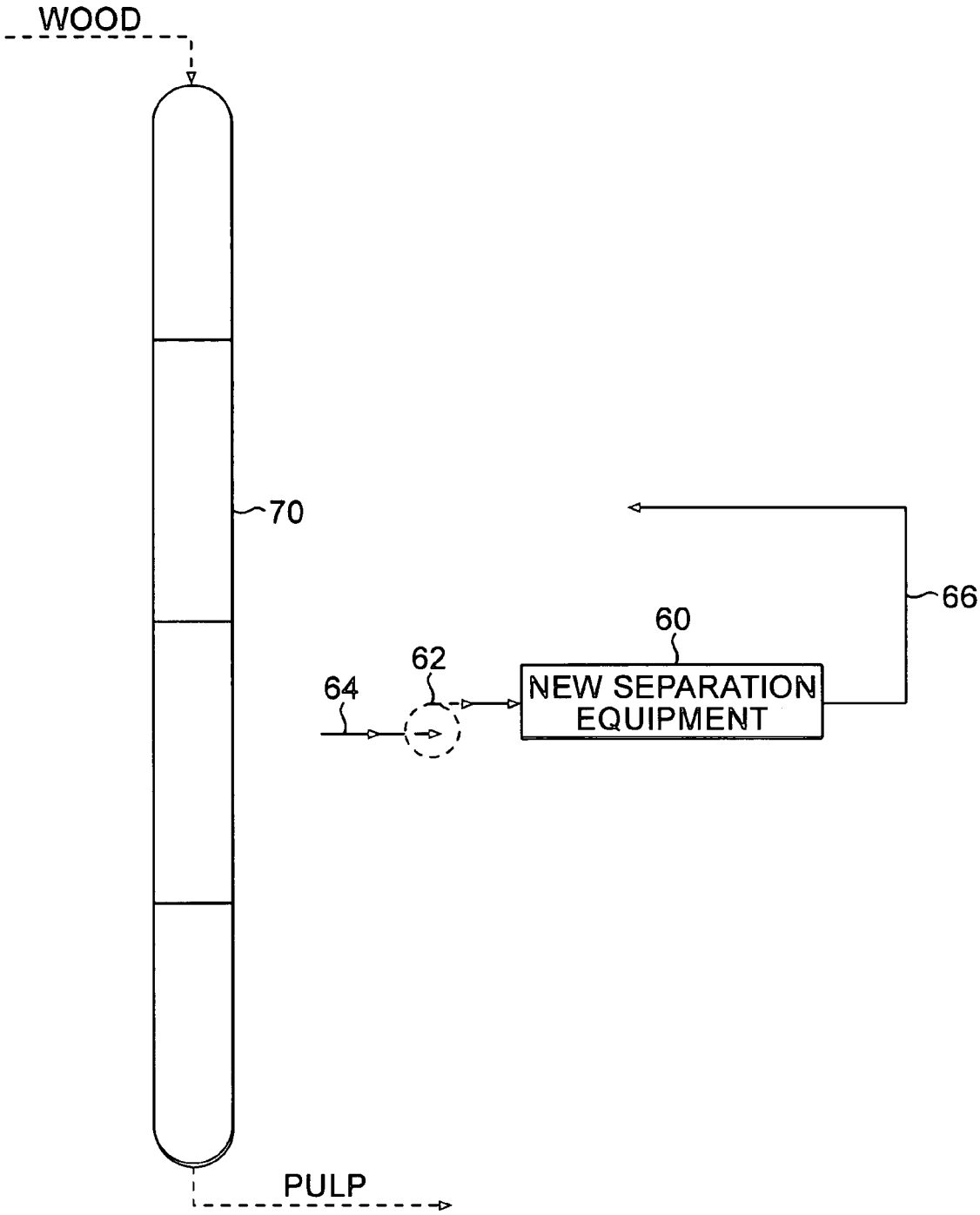
FIG. 5 is a schematic representation of the process of the present invention applied in a continuous digester application.

FIG. 5 is a schematic representation of a continuous digester 70 and the related treatment system which is identical to the system of FIG. 4 which includes a digester recirculation system 62, separator 60, a source of liquor 64 and a return conduit 66. In the system of FIG. 5 the cellulosic material identified by arrow 71 is introduced into the top of the digester 70 and the pulp represented by arrow 73 is withdrawn from the bottom of the digester 70. As with the system of FIG. 4 the liquor can be withdrawn from any digester nozzle or other device in the digester section of the pulping process and the recovered liquor in line or conduit 66 eventually returned to any nozzle in the digester. A heat exchanger (not shown) can be incorporated into any part of the liquor recirculation system to raise or lower the temperature of the liquor in accord with the overall digester and separation media requirements.

Figure 6:
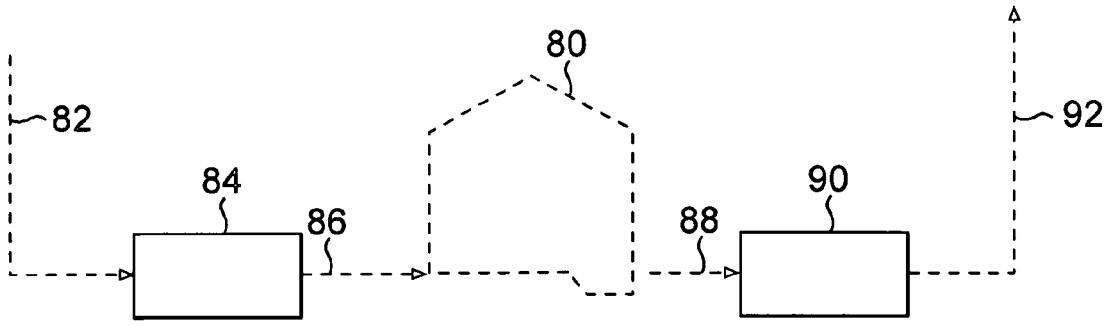
FIG. 6 is a schematic representation of the present invention applied to a portion of the tank farm incident to a pulping process utilizing storage tanks.

FIG. 6 represents the present invention applied to a storage system 80 for liquor which is stored for reuse or for further processing to recover chemical values. The liquor can be withdrawn from any source in the pulping train and is represented by arrow 82. The liquor containing high molecular weight solids in line 82 can be passed through a separator 84 and the resulting liquor with lower concentration of the high molecular weight organic by-products conducted via conduit 86 to the storage tank 80. Liquor withdrawn from the storage system 80 via conduit 88 can also be conducted through a separation step 90 for removal of high molecular weight organic by-products prior to a return of the liquor to any point in the pulping process where such liquor is used via line 92, including the same or a different storage tank. In this scheme the liquor can be treated before entry into the storage facility and after withdrawal from the storage facility. It is also within the purview of the present invention to treat the liquor, both entering and leaving the storage facility 80 or just entering the storage facility or just when leaving the storage facility 80.

Figure 7:
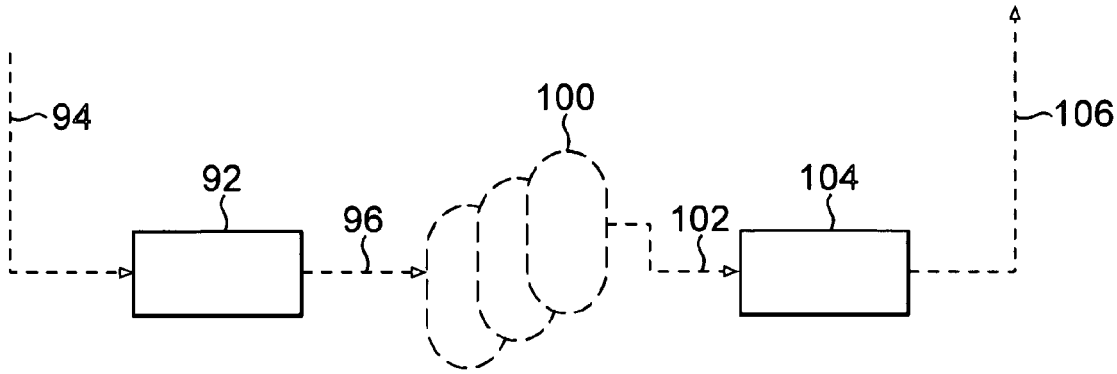
FIG. 7 is a schematic representation of the present invention applied to another portion of the tank farm area incident to a pulping process scheme utilizing pressurized accumulators.

FIG. 7 shows application of the process of the present invention to accumulators used during a pulping process. The accumulators 100 are connected to a separator 92 which receives liquor from any source in the pulping train which is represented by arrow 94. The liquor is passed through the separator 92 where high molecular weight organic solids are removed and thus treated liquor with a lower concentration of high molecular weight organic solids is placed into the accumulator 100 via conduit 96. Liquor withdrawn from the accumulator 100 can be conducted via conduit 102 to a separator 104 so that the liquor is again subjected to a filtration and removal of high molecular weight organic solids with a cleaner liquor being returned to any point in the pulping process where such liquor is used via conduit 106, including the same or a different accumulator. As with the system of FIG. 6 the liquor can be treated before entry into a pressurized accumulator and after withdrawal therefrom. It is also within the scope of the present invention to treat the liquor both entering and leaving any accumulator or just before entry into or when being withdrawn from any accumulator.

Figure 8:
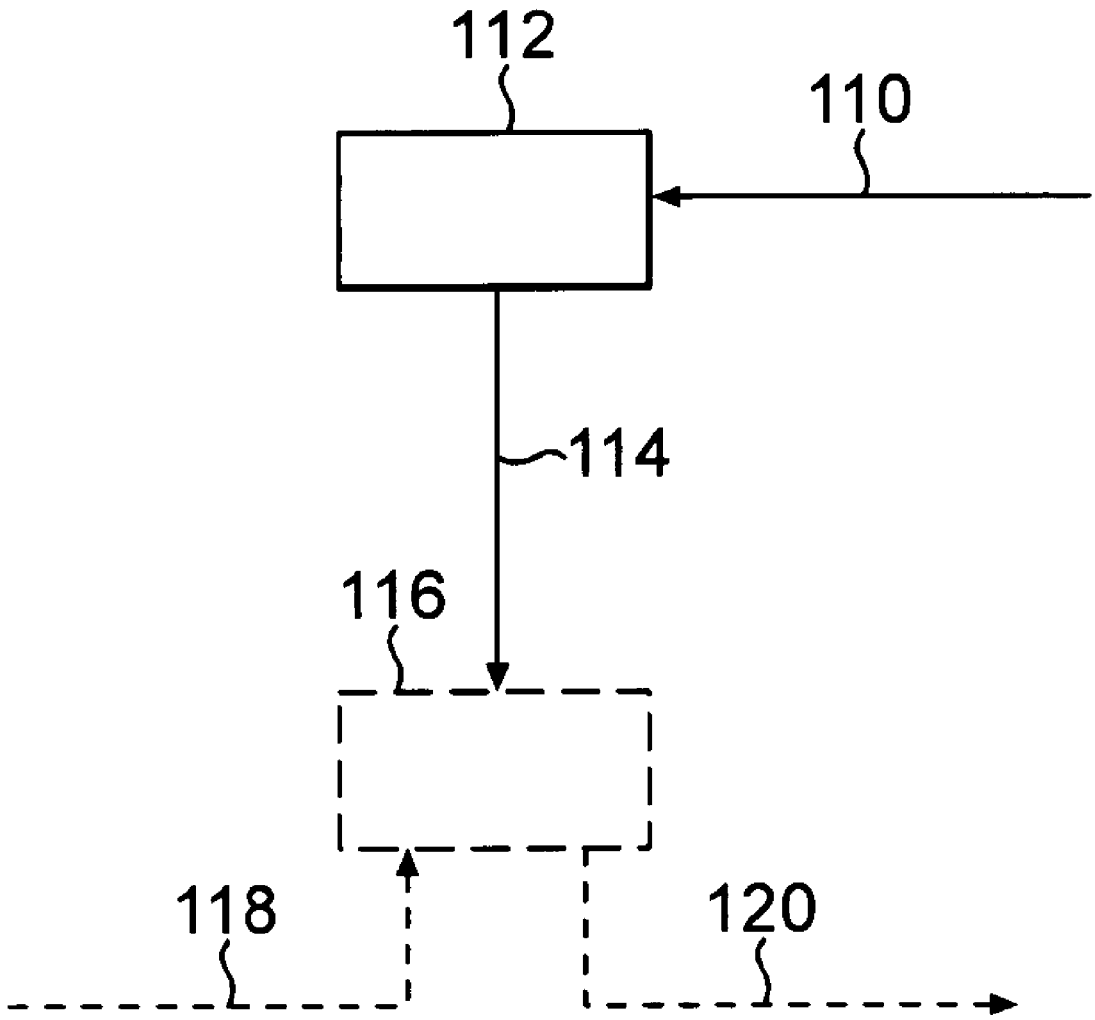
FIG. 8 is a schematic representation of the present invention applied to a pulping process wherein dilution of the pulp is a process step.

FIG. 8 is a schematic representation of pulp dilution where the process of the present invention is used to clean liquor filtrate containing organic solids (high molecular weight organic by-products) which is represented by arrow 110. The filtrate 110 containing organic solids is passed through a separator 112 which contains a media adapted to remove high molecular weight organic by-products. A processed filtrate or liquor lower in concentration of high molecular weight organic solids represented by arrow 114 is sent to a dilution zone 116 contained in any pipe or equipment in the pulping process. Higher consistency pulp represented by arrow 118 enters the dilution zone 116 where it is contacted by the processed filtrate or liquor to yield an output of lower consistency pulp represented by arrow 120.

Figure 9:
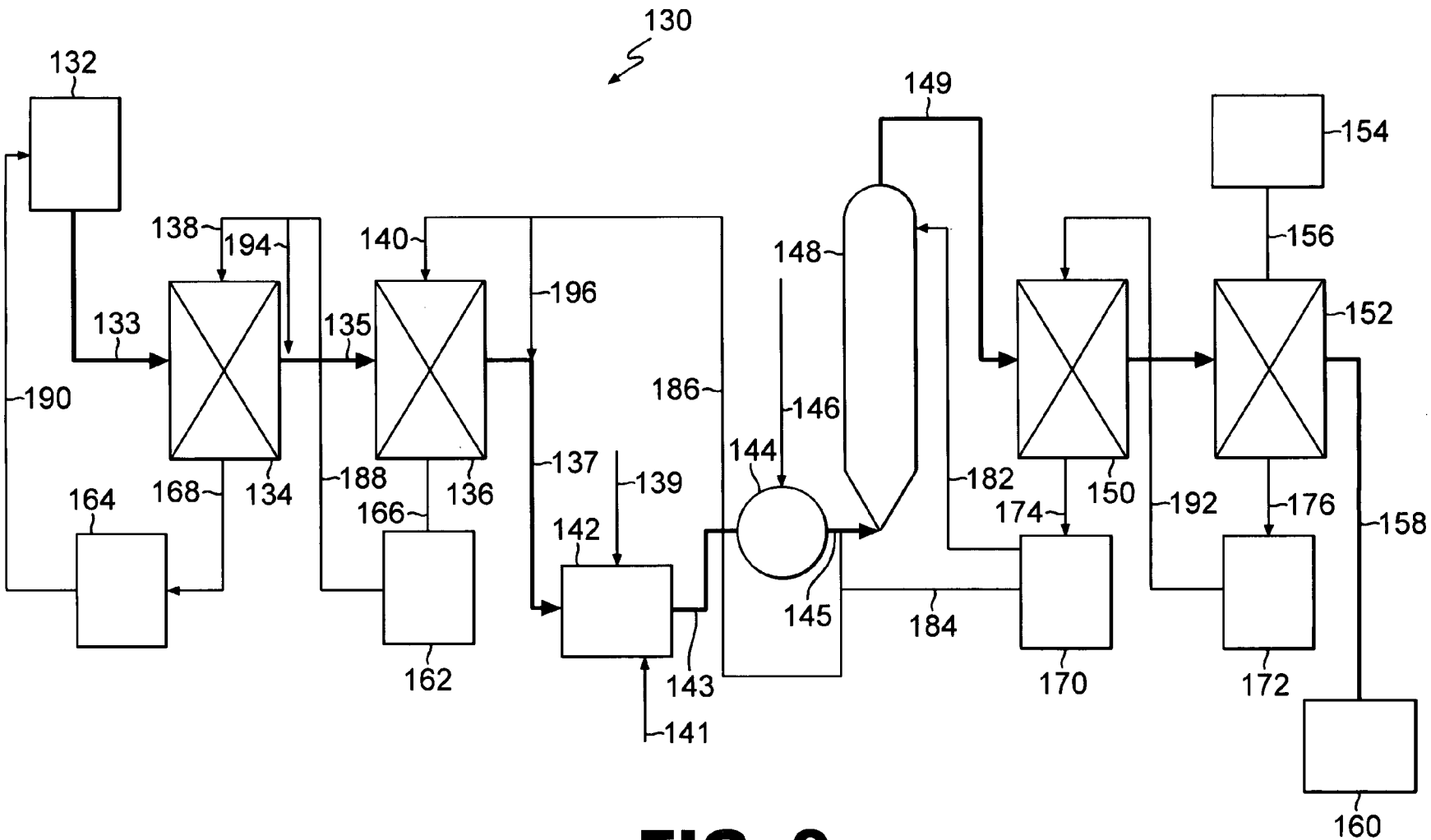
FIG. 9 is a schematic representation of the present invention applied to a pulping process including an oxygen delignification step.

FIG. 9 is a schematic representation of a typical pulping process 130 which includes an oxygen delignification step. In the process 130 the pulp is subjected to an initial cooking or digesting in a digester or digester plant represented by box 132. The pulp is delivered via conduit 133 to a first pulp washer 134 and then via conduit 135 to a second pulp washer 136. Pulp washer 134 has filtrate recycle conduit 138 whereby filtrate from tank 162 is used as all or part of the washing fluid in pulp washer 134 to wash the pulp. The pulp washers 134 and 136 have associated filtrate tanks 162 and 164 which receive filtrate via lines 166 and 168. The washed pulp is conducted via line 137 to a steam injector 142 where steam indicated by arrow 141 and sodium hydroxide indicated by arrow 139 are added to the pulp which then flows by conduit 143 to a chemical mixer 144 wherein oxygen indicated by arrow 146 is added to the pulp. The pulp in line 145 is then connected to the bottom of an up-flow oxygen reactor 148 where the oxygen delignification takes place. The processed pulp exits the reactor 148 by conduit 149 and is sent to washers 150 and 152. Associated with washers 150 and 152 are filtrate tanks 170 and 172 respectively that receive filtrate from the washers 150 and 152 via conduits 174, 176 respectively. Filtrate from filtrate tank 172 can be re-circulated to washer 150 via line 192 to be used as all or part of the washing fluid in pulp washer 154.The washed pulp is then conducted via line 158 to a subsequent operation, e.g., a bleach plant represented by block 160.

In pulping process 130 clean water, represented by box 154, is added to the end most washer 152 in the series of pulp washers associated with the washing and oxygen delignification sections of the plant. The filtrate from tank 172 can be recycled to washer 150 in the series as shown by line 192. As shown in FIG. 9 filtrate from tank 170 can be used to dilute the pulp either downstream of the chemical mixer 144 or in the up-flow oxygen reactor 148. This filtrate can also be recycled to the last of the washers 136 prior to the injector 142 via conduit 186 or to the injector 142 via conduits 140 and 138. Filtrate from washer 136 can be sent to washer 134 via conduits 188 and 138. Filtrate in tank 164 can be returned to the digester plant via conduit 190 as is well known in the art.

It is within the scope of the present invention to take the streams in various conduits and subject them to a filtration media to remove colloidal or dissolved high molecular weight organic by-products from the stream. For example, referring to FIG. 9, the process of the invention can be applied to the clean water in conduit 156 the filtrate from washer 152 in line 176 and the filtrate from washer 150 in line 174, the filtrate in conduits 166, 168,182, 184, 186, 192, 196, 138, 140, 188, and 194, as well as conduit 190. In addition the apparatus can be included in conduit 190 as well as in conduits 166 and 168 thus removing colloidal and high molecular weight organic by-products from the filtrate, either before or after the respective storage tanks. Any or all of the streams enumerated that have colloidal or dissolved high molecular weight organic by-products removed resulting in a clean stream with a lesser amount of colloidal or dissolved high-molecular weight organic by-products will improve the overall efficiency of the pulping process shown in FIG. 9. In particular the oxygen reactor will be benefited by the process of the present invention. In addition to reusing the filtrate in the washers the clean filtrate can be used to dilute the pulp by being introduced into the first stage brown stock washer 134 via conduit 194. Dilution of the pulp can take place by introducing the cleaned filtrate into the up-flow oxygen reactor 148 via conduit 182 or into the pulp prior to entering the up-flow reactor 148 via conduit 184 and conduit 196.

FIG. 9 and the description relating thereto is of a typical washing sequence including oxygen delignification. The washing devices 134, 136, 150 and 152 can be rotary devices, presses any or other washing device used in the pulping of cellulosic material. There can be any number of washing devices, before or after the oxygen reactor 148, as determined by the overall process design and process requirements. In such a process the oxygen reactor 148 can be either an up-flow or a down-flow reactor.

Figure 10:
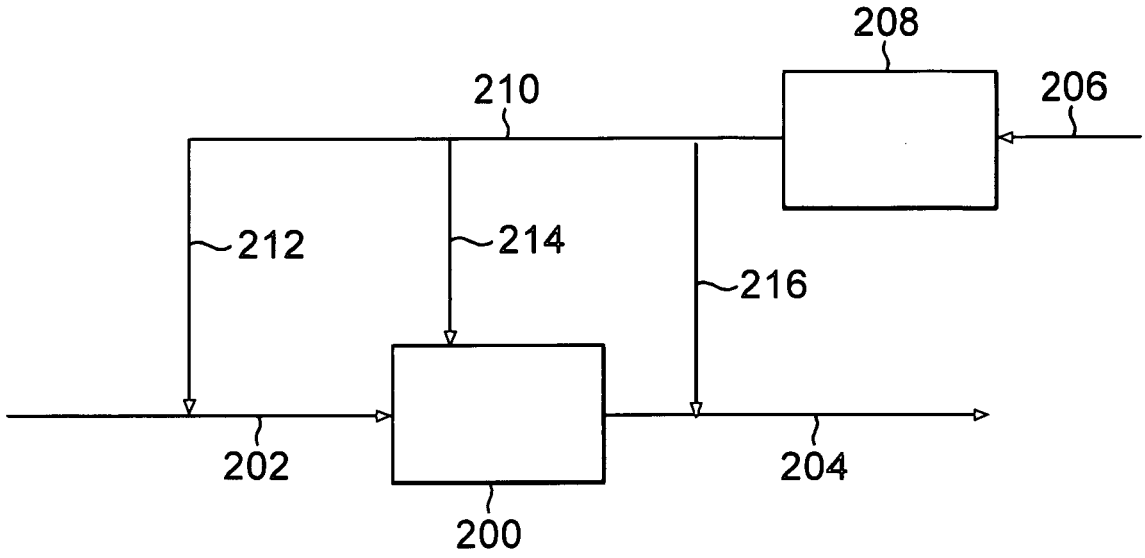
FIG. 10 is a detailed schematic representation of the present invention applied to an oxygen reactor used in oxygen delignification of pulp.

Referring to FIG. 10 the oxygen reactor is shown as 200. Pulp enters the oxygen reactor 200 via line or conduit 202 and treated pulp leaves reactor 200 via line or conduit 204. The reactions and processes of the oxygen reactor 200 are well known resulting in a further delignified pulp in line or conduit 204. As part of the oxygen reactor process it may be desirable to dilute the pulp before, during or after oxygen delignification of the pulp in reactor 200.

Dilution according to the present invention is effected by taking a process filtrate from any area of the pulping process train via line 206 and passing the filtrate through a filter media filtration step 208 to remove, or lower the concentration of, high molecular weight organic by-products in the filtrate. Filtrate leaving the filtration step 208 is conducted via line or conduit 210 and branch conduits 212, 214 and 216 to one of, or all of, the pulp in conduit 202, pulp in the reactor 200 or pulp in conduit 204 to effect dilution in accord with the requirements of the overall process.

Cleaning and screening can take place anywhere in the pulping process where logic, good science or good engineering would dictate.

The foregoing figures and related description are merely illustrative of the present invention. In its broadest terms the use of a separation step to remove dissolved or colloidal or dissolved high molecular weight organic by-products can be applied anywhere in the pulp manufacturing plant (including washing and bleaching of the pulp) to improve overall physical or chemical process efficiency.

For example in the digesting area of a pulp mill, removal of the dissolved high molecular weight organic by-products produced from the cooking reactions will allow for less interference and higher concentration gradients in subsequent cooking reactions needed to produce or liberate fibers from the cellulosic material. Additionally, the cooking chemicals will not be depleted by unwanted reactions that occur between high molecular weight organic solids when the liquor has been treated according to the present invention. Thus, the concentration of cooking chemicals can be reduced for the same amount of cellulosic material produced because side reactions with high molecular weight organic materials do not occur. Lastly, a decrease in the concentration of cooking chemicals required to produce the pulp will also reduce damaging reactions to the cellulosic materials that occur with higher concentrations of cooking chemicals.

In the washing operations dissolved high molecular weight organic by-products in the counter current shower flow can be reduced which increases the concentration gradients for mass transfer and therefore increases the washing efficiency. An increase in washing efficiency would decrease the demand for fresh or clean water in a given plant, which is also referred to as a decrease in dilution factor. The dilution factor is the excess water that must be evaporated. This would decrease the energy requirements of the evaporation plant because less liquid would be evaporated.

Extended delignification of cellulosic material after the cooking plant can be obtained with the use of oxygen. The demand for oxygen and other chemicals required for oxygen delignification would decrease, because, the unwanted reactions with the high molecular weight organic by-products would be decreased. A lower concentration of oxygen and other chemicals would decrease the destructive effects on the cellulosic material.

The benefits of the present invention would be immediate upon removal of a minimum of 10% by weight (based on inlet flow) of the dissolved or colloidal high molecular weight organic by-products from any stream being treated according to the invention.

Furthermore, removal of high molecular weight organic by-products would benefit in the physical activities that are required to occur in cooking processes. For example, better diffusion of the cooking chemicals into the wood would ultimately result in a lower concentration of active chemical required, which would decrease destructive side reactions to the fiber itself. This in turn would produce a higher yield of the desired product and lower operating costs due to lower concentration of the active chemical applied to the wood. Lastly, better diffusion would decrease the amount of uncooked or partially cooked wood, i.e., waste.

Removal of large agglomerated colloidal molecules, such a pitch, would decrease the re-deposition of the colloidal molecules on the pulp, thereby increasing the cleaning efficiency of the washing or extraction device. This would decrease the demand for bleaching chemicals in subsequent bleaching steps. Also, the amount of clean water necessary for the washing plant may be decreased, if the possibility of re-deposition is decreased.

It is believed that immediate monetary benefit to the pulp producer would come from filtering the filtrate used in the washing area of the pulping process. Specifically, the filtrate used for dilution and washing surrounding an oxygen delignification reactor which is in the Brown Stock washing area (after cooking, but before bleaching) would be a prime target for the process of the present invention. Using the process of the present invention in the cooking area of a pulp mill would be effected after application to the washing area of the plant.

As used in the foregoing specification and the appended claims the term dissolved high molecular weight organic by-products is taken to mean any and all of dissolved organic solids, colloidal or dissolved organic solids and colloidal or dissolved high molecular weight organic by-products.

It would be readily apparent to those skilled in the art that the present invention would find application in any cellulosic pulping mill or process. The order and number of unit operation for one pulp mill may be different then those for another mill. Therefore the description of the present invention includes application to all pulp mills regardless of equipment layout or operating process.

Research into pulping processes is an on going effort. Newer chemical pulping processes have been developed and are being demonstrated in the laboratory, e.g. using potassium hydroxide (KOH) and nitrogen compounds such as ammonia. These newer process will also benefit from the methods of the present invention

Having thus described my invention what is desired to be secured by Letter Patent of the United States is set forth in the appended claims which should be read without limitation.

What is claimed:

1. A method for improving the efficiency of a wood pulping process using a displacement batch digester wherein said displacement batch digester uses untreated pulp washing fluid to displace hot black liquor from said digester to an accumulator, comprising the step of passing said untreated pulp washing fluid through filtration media to remove all or a portion of high molecular weight organic by-products from said washing fluid to increase concentration gradients for mass transfer prior to said washing fluid being used to displace said hot black liquor.

2. A method according to claim 1 including the step of using membrane separates to remove said high molecular-weight organic by-products from said liquor.

3. A method for improving the efficiency of a wood pulping process incorporating dilution of pulp comprising the step of:

withdrawing filtrate containing high molecular weight organic by-products from any washing step;

passing said filtrate through a filter media to remove high molecular weight organic by-products to yield a treated filtrate with a lower concentration of colloidal and/or high molecular weight organic by-products to increase concentration gradients for mass transfer; and using said treated filtrate in any dilution zone, pipe or equipment in said pulping process to dilute said pulp.

4. A method according to claim 3 including the step of using membrane separation to remove said high molecular-weight organic by-products from said filtrate.

5. A method for improving the efficiency of a wood pulping process including fiber washing in a multi-stage washing process comprising the steps of: separating washing liquid from said washed fibers in one of a last stage or any stage except said first stage of said multi-stage washing process, passing said washing liquid through a filtration media to remove high molecular weight organic by-products from said washing liquid to produce a washing liquid having a reduced quantity of high molecular weight organic by-products and increased concentration gradients for mass transfer, and using said washing liquid having a reduced quantity of high molecular weight organic by-products in a stage of said multi-stage washing process preceding the stage from which said washing liquid was withdrawn.

6. A method according to claim 5 including the step of using membrane separation to remove said high molecular-weight organic by-products from said washing liquid.

7. A method for improving the efficiency of a wood pulping process that includes oxygen as a delignification stage proceeded by and followed by washing of pulp comprising the steps of:

separating washing fluid from said pulp after one of any of the washing steps proceeding, or any of the washing steps following said oxygen delignification step, passing said separated washing fluid from said pulp through a filtration media to remove high molecular weight organic by-products from said washing fluid to produce a cleaned washing fluid with increased concentration gradients for mass transfer, and using said cleaned washing fluid in any one of any washing operation or to dilute said pulp prior to, after, or during oxygen delignification.

8. A method according to claim 7 including the step of using membrane separation to remove high molecular-weight by-products from said washing fluid.

* * * * *